US005532797A

United States Patent [19]

Arcaro

[11] Patent Number: 5,532,797

[45] Date of Patent: Jul. 2, 1996

[54] REPLACEABLE PHOTOCONDUCTOR-CONTAINING CANISTER FOR AN ELECTROPHOTOGRAPHIC PRINTER

[75] Inventor: David J. Arcaro, Boise, Id.

[73] Assignee: Hewlett-Packard Company, Palo Alto, Calif.

[21] Appl. No.: 346,977

[22] Filed: Nov. 29, 1994

[51] Int. Cl.[6] ..... G03G 5/00

[52] U.S. Cl. ..... 355/213; 242/348.2; 355/72

[58] Field of Search ..... 355/213, 72; 242/326.1, 242/326.2, 348.1, 348.2, 348.3; 378/182; 354/275

[56] References Cited

U.S. PATENT DOCUMENTS

| | | | |
|---|---|---|---|
| 3,829,208 | 8/1974 | Van Meijel et al. | 355/213 |
| 4,102,570 | 7/1978 | Shimoda | 355/213 X |
| 4,637,711 | 1/1987 | Fujisawa et al. | 355/72 |
| 4,832,197 | 5/1989 | Hara | 242/71.1 X |
| 4,914,479 | 4/1990 | Ogura et al. | 355/213 |
| 5,142,305 | 8/1992 | Maslanka et al. | 355/213 X |
| 5,362,008 | 11/1994 | Nagel et al. | 355/72 X |

FOREIGN PATENT DOCUMENTS

| | | | |
|---|---|---|---|
| 4139427 | 6/1992 | Germany | 355/213 |

*Primary Examiner*—Robert Beatty

[57] ABSTRACT

A replaceable OPC-containing canister is provided for a drum in an EP apparatus, the drum including a canister-receiving receptacle. The OPC-containing canister comprises a housing which includes an elongated slot. An OPC web is wound around a spring-loaded mandrel within the interior of the housing and includes a distal end that extends through the elongated slot. An end attachment is coupled to the distal end of the OPC web and is spring biased against the housing by action of the spring loaded mandrel. The end attachment, upon insertion of the OPC canister into the canister-receiving receptacle in a drum, is positioned to engage fixed stops in the EP apparatus. Upon rotation of the drum, the end attachment thus bears against the stops, unrolls the OPC web from the canister and winds the OPC web about the external surface of the drum. Reverse rotation of the drum enables removal of the OPC-containing canister.

9 Claims, 6 Drawing Sheets

REPLACEABLE PHOTOCONDUCTOR-CONTAINING CANISTER FOR AN ELECTROPHOTOGRAPHIC PRINTER

FIELD OF THE INVENTION

This invention relates to electrophotographic (EP) printing and, more particularly, to a replaceable canister containing an organic photoconductor (OPC) web for use in an EP printer.

BACKGROUND OF THE INVENTION

EP apparatus, including EP copiers and EP printers, employ OPC coated drums and webs. While EP printers that employ OPC webs are generally arranged to enable replacement of the OPC web, EP printers which employ OPC-coated drums generally require the replacement of the entire drum assembly during the course of periodic maintenance.

U.S. Pat. No. 3,588,242 describes a drum structure which permits advancing of a photoconductor web positioned about the drum. The OPC web is stored in roll form on supply and take-up spindles within the interior of the drum. The photoconductor web extends from the supply role to the exterior of the drum, about the exterior periphery of the drum and then back into the interior of the drum to the take-up roll. To advance the OPC web, a length of OPC web is unrolled from the supply role (and taken up by the take-up role) such that a new length of OPC web is positioned about the periphery of the drum. In order to replace the OPC web, the drum must be disassembled and the internal supply and take-up rolls removed and replaced. Such action is not performable by the normal user and requires a maintenance call.

To maintain the cost of EP apparatus as low as possible, the industry trend has been to enable user-replacement of parts that are subject to wear. Presently, EP apparatus that employ drums are often provided with a replaceable toner cartridge which includes not only a replacement toner supply, but also an entirely new drum structure. Because the OPC coating on the drum has a shorter lifetime than the drum structure, replacement of the toner cartridge results in replacement of drum parts that have considerable useable life remaining.

Accordingly, it is an object of this invention to provide an EP apparatus with a user replaceable OPC web canister.

It is another object of this invention to provide a replaceable OPC-containing canister for an EP apparatus that employs a drum structure.

It is yet another object of this invention to provide an OPC-containing canister which is both simple and inexpensive in structure and is user-replaceable in a drum-containing EP apparatus.

SUMMARY OF THE INVENTION

A replaceable OPC-containing canister is provided for a drum in an EP apparatus, the drum including a canister-receiving receptacle. The OPC-containing canister comprises a housing which includes an elongated slot. An OPC web is wound around a spring-loaded mandrel within the interior of the housing and includes a distal end that extends through the elongated slot. An end attachment is coupled to the distal end of the OPC web and is spring biased against the housing by action of the spring loaded mandrel. The end attachment, upon insertion of the OPC canister into the canister-receiving receptacle in a drum, is positioned to engage fixed stops in the EP apparatus. Upon rotation of the drum, the end attachment thus bears against the stops, unrolls the OPC web from the canister and winds the OPC web about the external surface of the drum. Reverse rotation of the drum enables removal of the OPC-containing canister.

DETAILED DESCRIPTION OF THE INVENTION

Figure 1:
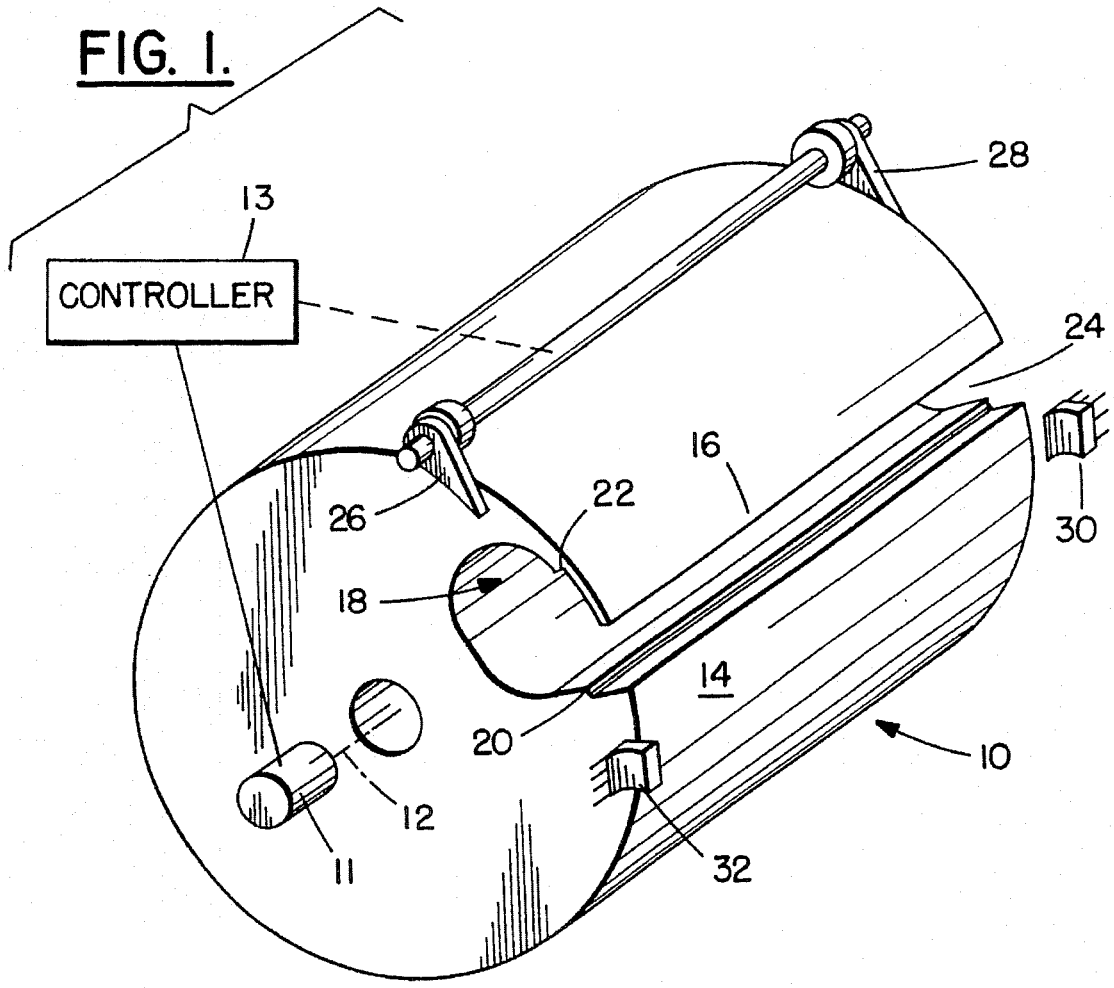
FIG. 1 is a perspective view of a drum that includes a receptacle for receiving an OPC-containing canister.

Referring to FIG. 1, a drum 10 is positioned in an EP apparatus (not shown) and rotates about center line 12. A motor 11 is coupled to drum 10 and is operated by a controller 13 to cause drum 10 to rotate either clockwise or counter-clockwise. Drum 10 includes an outer cylindrical surface 14 which, unlike many prior art EP drums, has no resident OPC layer thereon. A drum surface extension 16 projects over and substantially encloses an OPC canister chamber 18 that extends from one end of drum 10 to another. The internal cross sectional shape of OPC canister chamber 18 is that of an extended oval which enables an OPC canister positioned therein to move between two positions. In a first position, a portion of an OPC canister engages a drum front step 20, and in a second position, another portion of the OPC canister engages a drum rear step 22. A drum slot 24 enables an OPC web with an end attachment to extend therethrough and to be engaged by a pair of pick claws 26 and 28 (when operated by controller 13) and a pair of fixed stops 30 and 32.

As will be hereafter understood, combined actions of drum 10, stops 30 and 32 and pick claws 26 and 28 enable withdrawal of an OPC web from an OPC canister within canister chamber 18, a wrapping of the OPC web about surface 14 of drum 10 and an engagement of the drum attachment in a snap fashion to maintain the OPC web in place during subsequent rotations of drum 10. It is to be noted that pick claws 26 and 28 and stops 30 and 32 are positioned at the ends of drum 10 and engage portions of the OPC end attachment which extend past the respective ends of drum 10. Thus, apparatus for withdrawing and replacing the OPC web is not required to extend over surface 14 of drum 10 so as to reduce the area of the OPC available for imaging.

Figure 2:
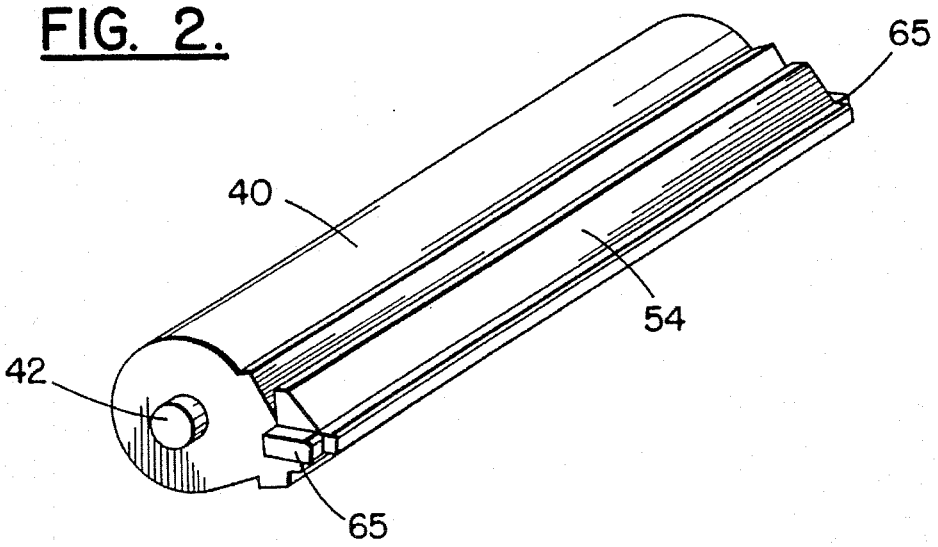
FIG. 2 is a perspective view of an OPC canister incorporating the invention hereof.
Figure 3:
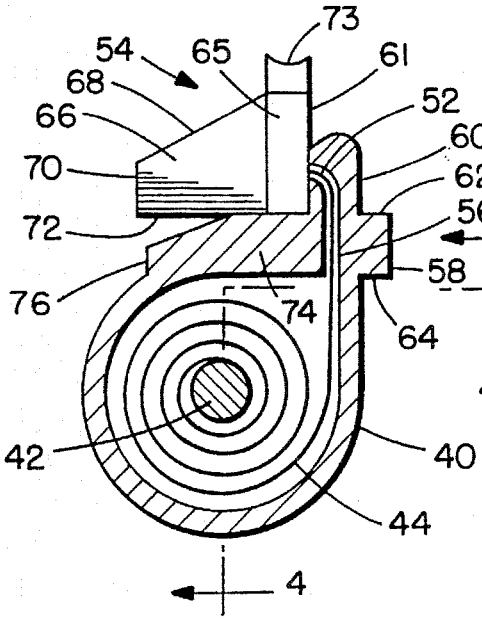
FIG. 3 is an end sectional view of the OPC canister of FIG. 2.

FIG. 2 shows a perspective view of a replaceable OPC canister 40. FIG. 3 shows an end view of OPC canister 40 wherein the end closure has been removed so as to enable a viewing of an internal mandrel 42, around which is wound a length of OPC web 44 (much like that in a 35 millimeter film canister).

Figure 4:
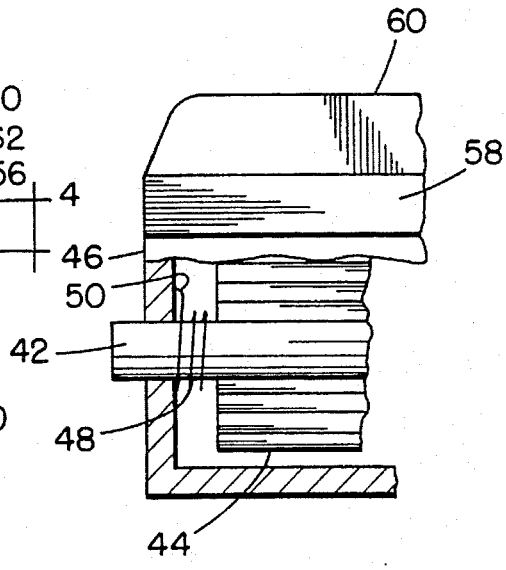
FIG. 4 is a partial sectional view of the OPC canister of FIG. 2, taken along line 4—4.

A section of OPC canister 40 is shown in FIG. 4 taken along line 4—4 in FIG. 3, showing the end wall structure thereof. Mandrel 42 is mounted for rotation in end wall 46 and a spring 48 is attached at point 50 to OPC canister 40 and also to mandrel 42. Spring 46 biases mandrel 42 in a counterclockwise direction so as to maintain OPC web 44 in a tightly wound configuration thereabout. A similar structure (not shown) is present at the opposite end of OPC canister 40.

To prevent the distal end 52 (see FIG. 3) of OPC web 44 from being fully drawn into the interior of OPC canister 40, distal end 52 is attached to a molded end attachment 54 which performs a number of functions during the withdrawal and replacement of OPC web 44. Distal end 52 of OPC web 44 extends through a slot 56 which passes through an upper shoulder portion 58 and a male "snap" member 60 of OPC canister 40. Distal end 52 of OPC web 44 is connected along the rear aspect 61 of end attachment 54. Upper shoulder portion 58 is provided with an upper ledge 62 and a lower ledge 64. Lower ledge 64 engages drum front step 20 upon insertion of OPC canister 40 into canister chamber 18.

End attachment 54 includes extremities 65 (see FIGS. 2 and 3) which extend past the ends of OPC canister 40. Extremities 65 are thereby positioned to engage and be engaged by pick claws 26 and 28 and stops 30 and 32. Also forming an integral portion of end attachment 54 is a wedge-shaped front tab 66 which includes an upper engaging surface 68, a flattened front portion 70 and a bottom-most region 72. End attachment 54 is further provided with a female snap portion 73 which is used to engage male snap member 60 when OPC web 44 is fully wrapped about surface 14 of drum 10 (to be described in detail below).

In a non-extended position, end attachment 54 rests upon a thickened portion 74 of OPC canister 40 and against a front-most surface of male snap member 60 (see FIG. 3). In this condition, OPC web 44 is tightly wound around mandrel 42, and maintains end attachment 54 in position. Thickened portion 74 of OPC canister 40 includes a front shoulder 76 which engages drum rear step 22 (see FIG. 1) when OPC web 44 is extended about surface 14 of drum 10.

Turning now to FIGS. 5–19, both insertion and withdrawal operations of OPC canister 40 will be described. To avoid over complicating the views of certain of the Figs., some reference numbers employed in FIGS. 1–4 have been omitted. During the description of FIGS. 5–9 the omitted reference numbers will be noted, and reference should be had to FIGS. 1–4 to enable a full understanding of the operation of the invention. OPC canister 40 and drum 10 are shown schematically "end-on" in FIGS. 7–12 and 14–19.

Figure 5:
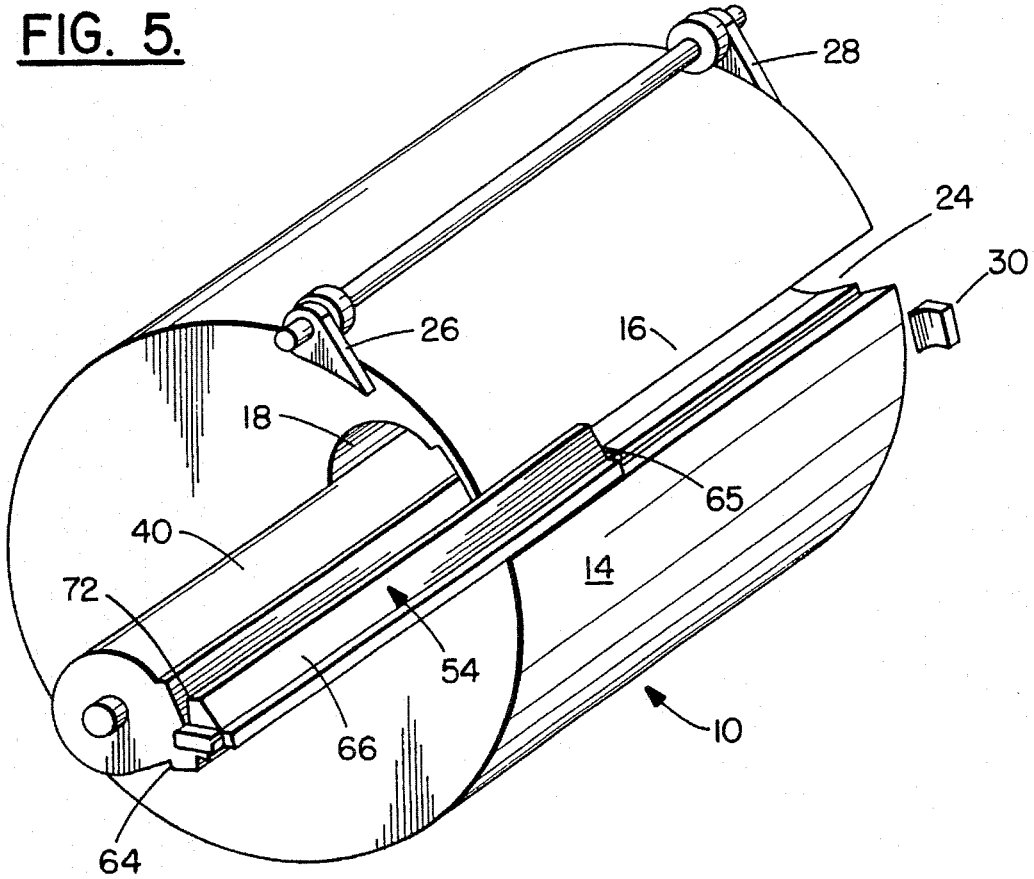
FIGS. 5 and 6 are perspective views of the OPC canister partially and fully inserted into a drum receptacle.
Figure 6:
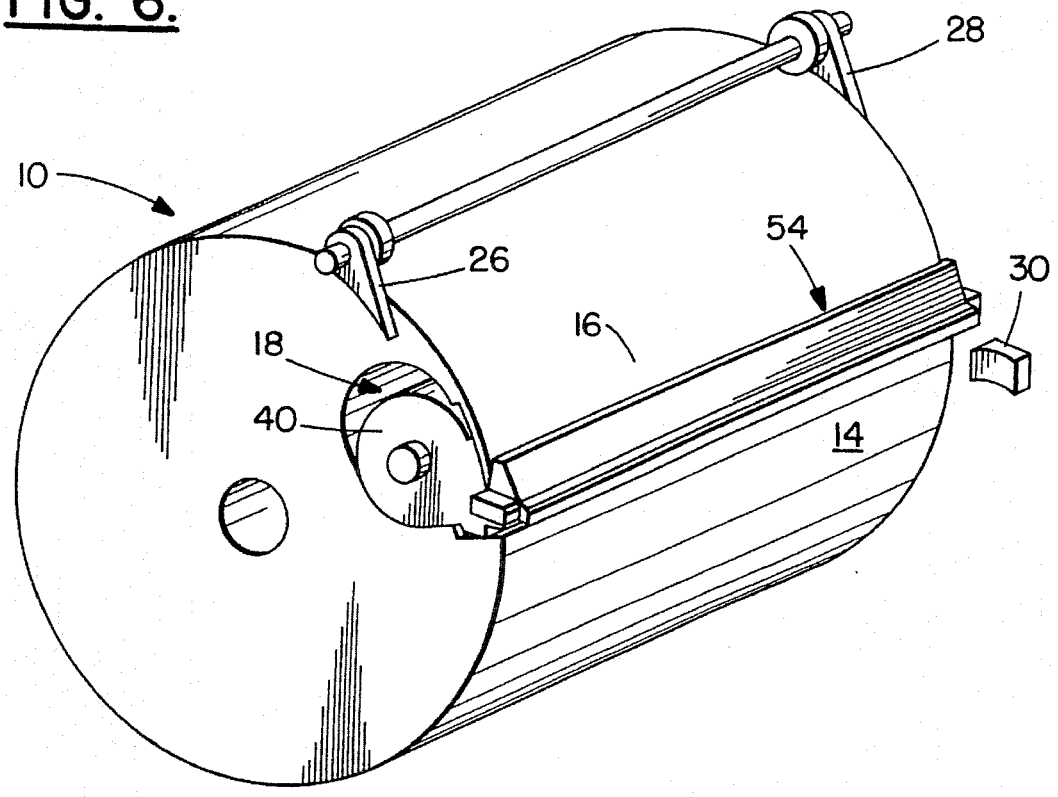
Figure 7:
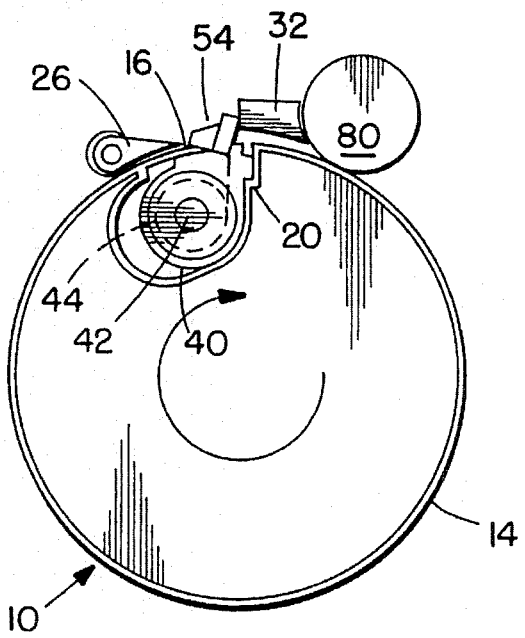
FIGS. 7–12 are a series of end views of a drum having an OPC canister positioned therein, illustrating the unwinding of an OPC web from the canister about the surface of the drum by rotation of the drum.

As shown in FIG. 5, insertion of OPC canister 40 into canister chamber 18 in drum 10, causes bottom most portion 72 of front engagement tab 66 to ride up and over drum surface extension 16. This action forces lower ledge 64 to engage drum front step 20 and positions end extremities 65 in a position to engage stops 30 and 32 (only stop 30 is shown in FIG. 5). FIG. 6 illustrates drum 10 when OPC canister 40 has been completely inserted in canister chamber 18. FIG. 7 is an end view of FIG. 6 and shows that, immediately behind stops 30 and 32, is a transfer roller 80 which engages surface 14 of drum 10 and acts to push end attachment 54 (and female snap member 73) into engagement with male snap member 60 after OPC web 44 is fully wrapped about drum 10. During insertion of OPC canister 40 and unwrapping of OPC web 44, pick claws 26 and 28 are maintained in a non-engaging position and perform no function.

Figure 8:
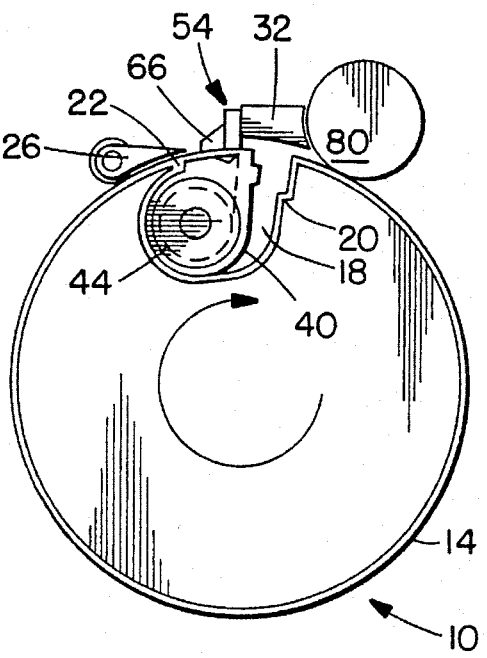

As shown in FIG. 8, once OPC canister 40 has been fully inserted into canister chamber 18, drum 10 is caused to rotate in a clockwise direction. Such rotation causes stops 30 and 32 to engage extremities 65 (stop 30 not shown). That engagement action causes OPC canister 40 to be pushed towards the left-most portion of canister chamber 18 and further causes front shoulder 76 to engage drum rear step 22. In addition, the engagement action with stops 30 and 32 causes a slight counter clockwise rotation of end attachment 54 that brings its bottom-most surface 72 into alignment with drum surface extension 16.

Front portion 70 of front tab 66 is flattened and acts like a "plow" to remove toner or other contaminants which have become attached to surface 14 of drum 10, as end attachment 54 proceeds along surface 14 of drum 10. If desired, bottom-most portion 72 of front tab 66 may be treated to include a tacky layer so that any residual toner adheres thereto during the movement of end attachment 54 along surface 14.

Figure 9:
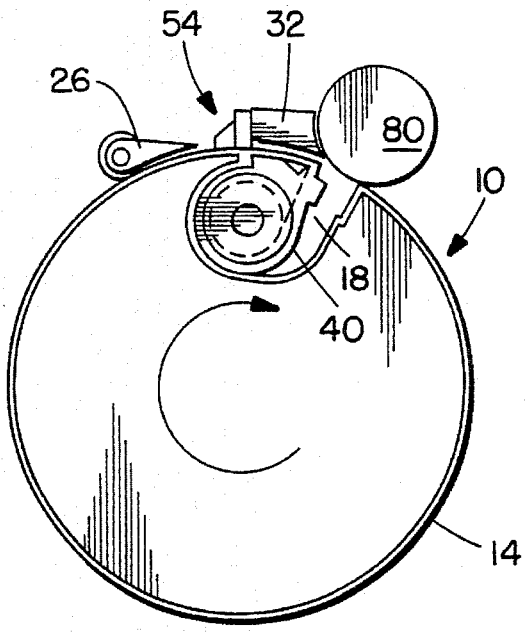
Figure 10:
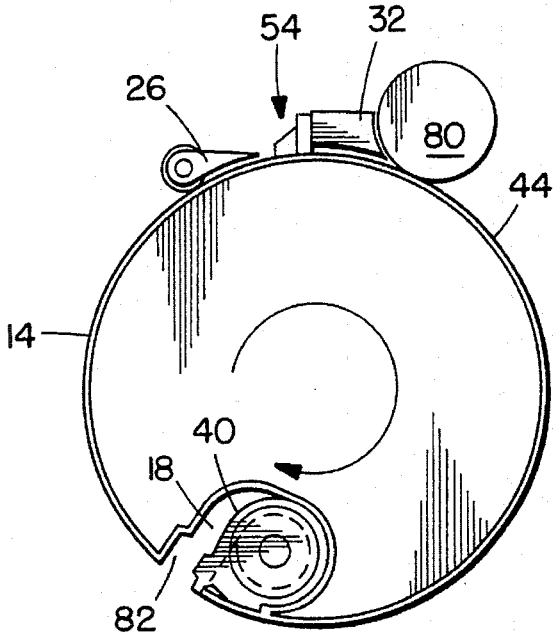

As shown in FIGS. 9 and 10, because end attachment 54 is maintained stationary by stops 30 and 32, rotation of drum 10 causes an unwrapping of OPC web 44 from within OPC canister 40. The rotation of drum 10 causes OPC web 44 to wrap about surface 14 so as to create an OPC layer thereon for subsequent use during the operation of the EP apparatus.

Figure 11:
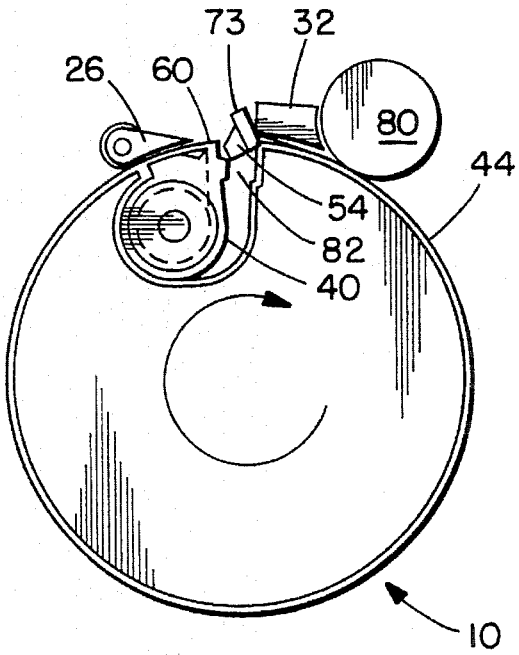
Figure 12:
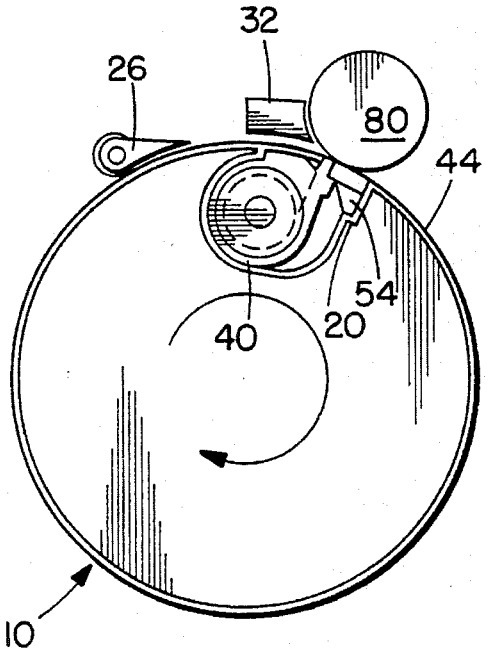

Tension exerted as OPC web 44 unwraps causes OPC canister 40 to remain engaged with drum rear step 22. This action exposes a portion 82 of drum slot 24 (see FIG. 10) and enables it to receive end attachment 54. In FIG. 11, drum 10 has rotated to such an extent that stops 30 and 32 are beginning to cause end attachment 54 to rotate in a counter clockwise direction about the right most edge of drum slot 24 and into open area 82. Continued rotation of drum 10 causes a further clockwise rotation of end attachment 54 (see FIG. 12) and causes front portion 70 of front tab 66 to engage drum front step 20. This action also causes female snap region 73 to engage male snap member 60. The actual snap engagement occurs when further drum rotation causes transfer roller 80 to roll over rear surface 61 of end attachment 54.

Figure 13:
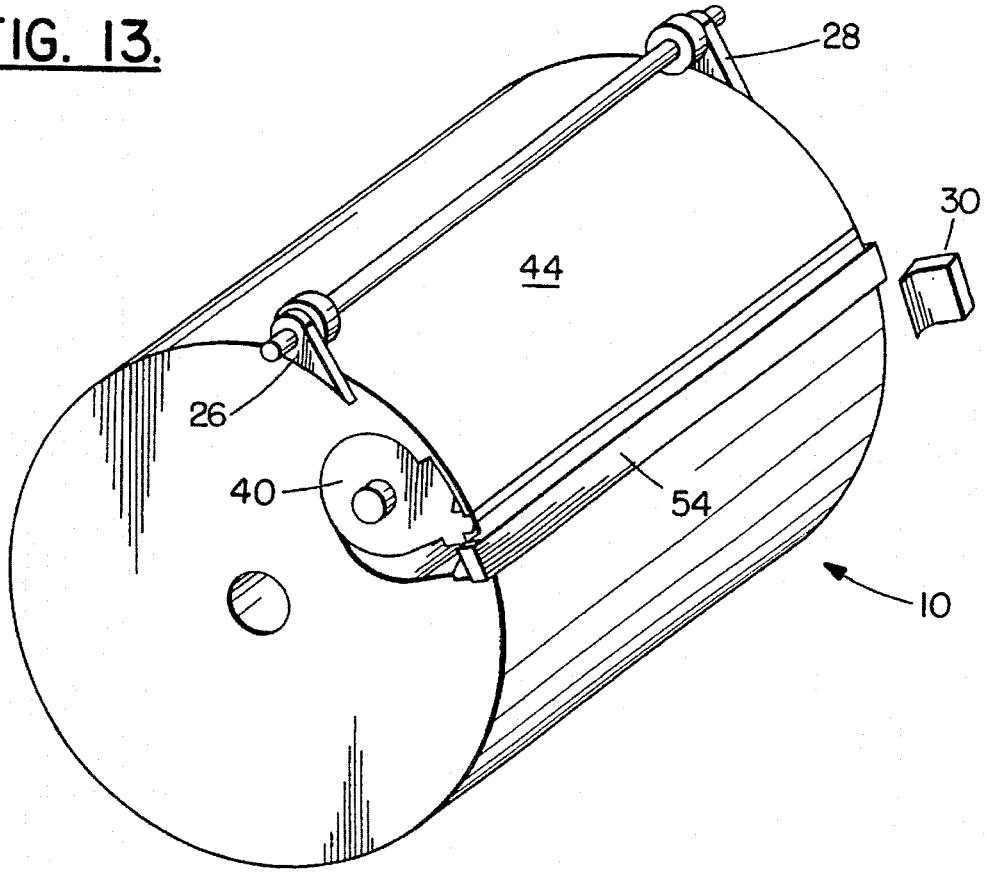
FIG. 13 is a perspective view of the drum when the OPC web has been fully unwound.

The snap engagement between female snap region 73 and male snap member 60 maintains OPC web 44 tightly wound about surface 14 of drum 10. Spring biased mandrel 42 maintains OPC web 44 in tension, thereby enabling OPC web 44 to thereafter be used for imaging purposes. FIG. 13 is a perspective view of drum 10 after the aforesaid snap engagement occurs.

At the end of the useful life of OPC web 44, the invention enables OPC canister 40 to be easily removed for replacement. The removal action is shown in FIG. 14–19. To commence a removal action, pick claws 26 and 28 are rotated in a clockwise direction into an engagement position. The mechanism for causing such rotation is not illustrated, but is obvious to those skilled in the art.

Figure 14:
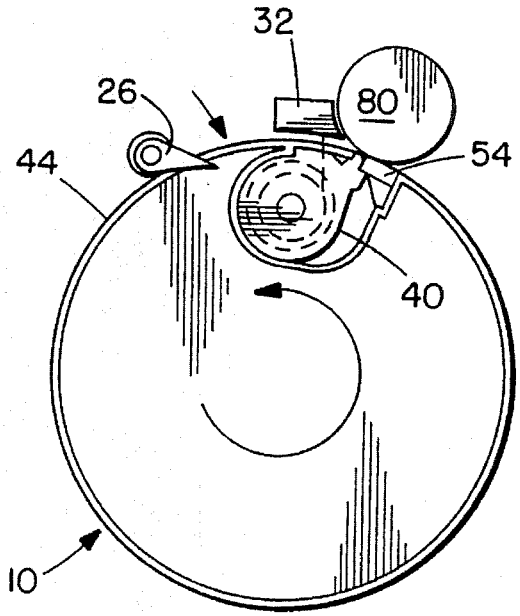
FIGS. 14–19 illustrate the steps involved in the detachment of an OPC web from the surface of a drum and the return of the OPC web into the OPC canister.
Figure 15:
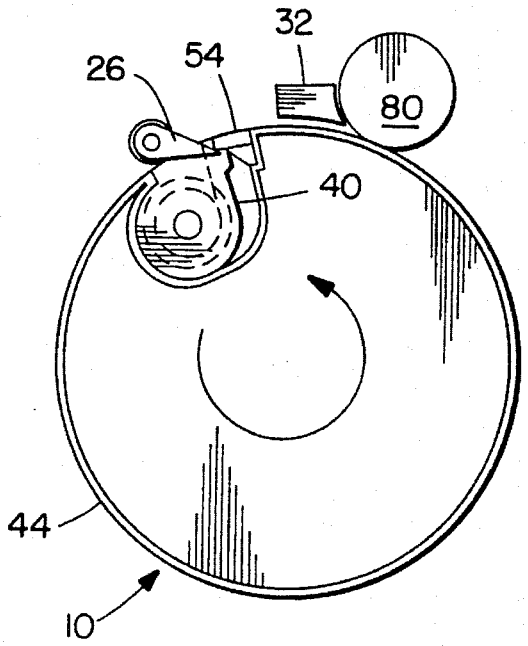
Figure 16:
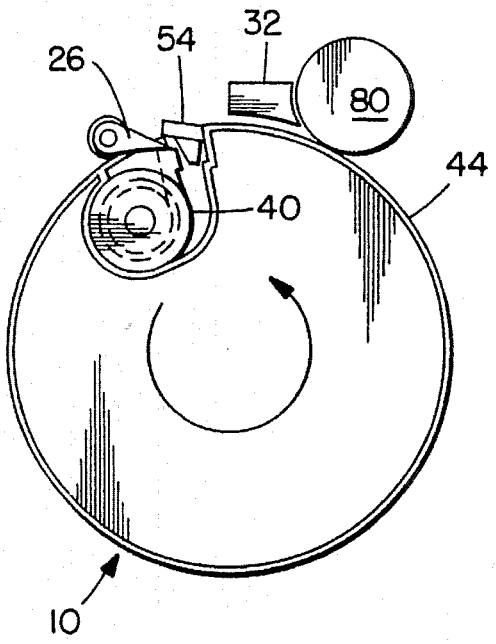
Figure 17:
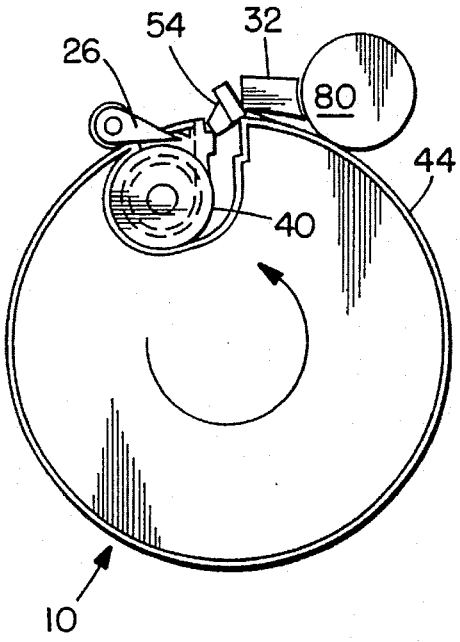
Figure 18:
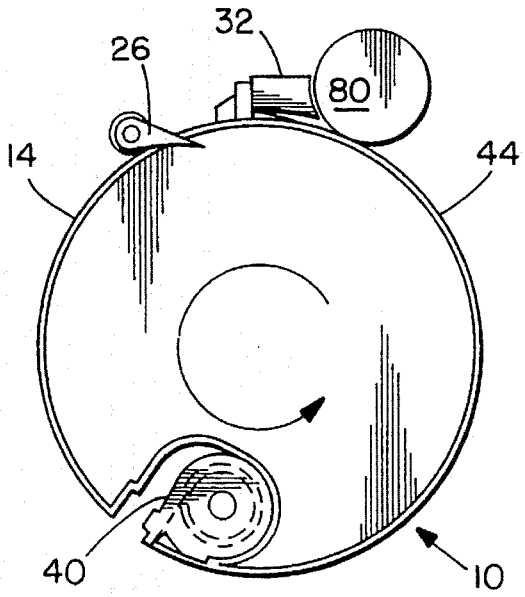

The direction of rotation of drum 10 is reversed to a counterclockwise direction (see FIG. 14). Pick claws 26 and 28 then come into engagement with the extremities 65 of end attachment 54 and such action causes disengagement of female snap member 73 from male snap member 60. End attachment 54 thus rotates in a clockwise direction until coming into engagement with end stops 30 and 32 (see FIGS. 15, 16 and 17).

Figure 19:
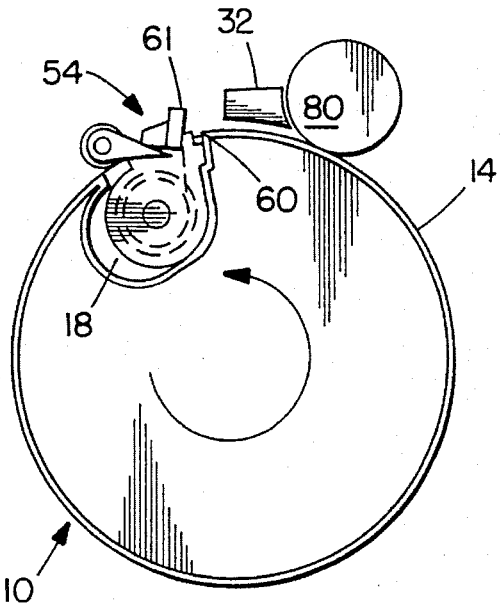

Continued rotation of drum 10 in a counterclockwise direction causes OPC web 44 to be drawn into OPC canister 40 (FIG. 18) and finally causes extremities 65 to again engage pick claws 26 and 28 (FIG. 19). The resulting pressure exerted by rear surface 61 of end attachment 54 on male snap member 60 causes a movement of OPC canister 40 to the right and into a removal position in canister chamber 18. At such point, pick claws 26 and 28 are rotated in a clockwise direction to disengage them from extremities 65. OPC canister 40 may then be removed from canister chamber 18.

While not shown, those skilled in the art will understand that the controller of the EP apparatus includes both OPC insertion and withdrawal cycles. The OPC canister removal cycle controls the amount of counter rotation of drum 10 and the operation of pick claws 26 and 28. Once OPC canister 40 has been removed, the process may be repeated by inserting a new OPC canister 40 and instituting an OPC insertion cycle.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A canister, including an organic photoconductor web, for an electrophotographic (EP) apparatus that includes a drum with a canister-receiving receptacle and a slot which communicates between said receptacle and an exterior cylindrical surface of said drum, said canister comprising:

an elongated casing including an elongated slot communicating between an outer surface of said casing and a chamber within said casing;

a spring loaded mandrel positioned within said chamber;

a flexible OPC web wound around said mandrel and including a distal end that extends through said elongated slot;

an end attachment coupled to said distal end of said flexible OPC web and spring biased against an outer surface of said casing by action of said spring loaded mandrel, said end attachment, upon insertion of said elongated casing into said canister-receiving receptacle, positioned to engage stop means in said EP apparatus, whereby rotation of said drum causes said end attachment to bear against said stop means and to cause an unrolling of said OPC web during continued rotation of said drum, said end attachment and elongated casing including means for preventing withdrawal of said OPC web back into said casing by said spring loaded mandrel when said OPC web surrounds said exterior cylindrical surface of said drum.

2. The OPC canister as recited in claim 1 wherein said end attachment includes extremities which extend past ends of said elongated casing, said extremities engaging opposed stops, which comprise said stop means, in said EP apparatus.

3. The OPC canister as recited in claim 1 wherein said end attachment includes an extended tab that engages said exterior cylindrical surface of said drum when said end attachment engages said stop means and said drum is rotated so as to cause a feeding of said OPC web from said spring loaded mandrel, rotation of said drum causing said extended tab to create a plowing action to remove residual toner present on said surface of said drum.

4. The OPC canister as recited in claim 3 wherein said extended tab includes a lower-most portion which engages said exterior cylindrical surface of said drum, said lower most portion having a toner-adherent surface.

5. The OPC canister as recited in claim 1 wherein said means for preventing comprises a first snap portion on said end attachment and a mating snap portion on said elongated casing, said first snap portion and mating snap portion adapted to engage in a snap connection when said drum has completed a substantially complete rotation and moved said end attachment into proximity with said elongated casing.

6. An electrophotographic (EP) apparatus comprising:

a drum including a canister chamber communicating with an exterior surface of said drum via a drum slot;

stop means positioned adjacent opposed ends of said drum;

an OPC canister including an elongated slot communicating between an outer surface of said canister and a hollow interior within said canister, said OPC canister adapted for insertion into said canister chamber in said drum;

a spring loaded mandrel positioned within said hollow interior;

a flexible OPC web wound around said spring loaded mandrel and held in tension by said spring loaded mandrel, a distal end of said OPC web extending through said elongated slot;

an end attachment coupled to said distal end of said OPC web, said end attachment positioned to extend through said drum slot upon insertion of said canister into said canister chamber, said end attachment including extremities which engage said stop means and prevent movement of said end attachment when said drum is rotated in a first rotative direction;

means for causing rotation of said drum in said first rotative direction, said rotation causing said end attachment to bear against said stop means and to cause an unwinding of said OPC web from said spring loaded mandrel and a wrapping of said OPC web about the exterior surface of said drum.

7. The EP apparatus as recited in claim 6 wherein said OPC canister includes a first snap connector and said end attachment includes a mating snap connector, said end attachment configured to enter said drum slot after said drum has been caused to complete a full rotation in said first rotative direction, so as to cause said mating snap connector to engage said first snap connector.

8. The EP apparatus as recited in claim 7 wherein a transfer roller is positioned in contact with the exterior surface of said drum and, by pressure engagement with said end attachment after said end attachment enters said drum slot, causes a snap connection between said mating snap connector and first snap connector.

9. The EP apparatus as recited in claim 8, further comprising:

plural claws postionable to engage said extremities of said end attachment; and means for causing said plural claws to move into an engagement position and to further cause said drum to rotate in a second rotative direction which brings said extremities into contact with said plural claws, further rotation of said drum enabling said plural claws to disengage said snap connection so as to enable said end attachment to be moved into a position which brings said extremities into contact with said stop means, and even further rotation of said drum enabling said spring loaded mandrel to withdraw said OPC web into said OPC canister.

* * * * *